US005630303A

United States Patent [19]

Devenish, III

[11] Patent Number: 5,630,303

[45] Date of Patent: May 20, 1997

[54] REMOTE ENCLOSURE ANCHOR FRAME AND INSTALLATION METHOD

[75] Inventor: William R. Devenish, III, Beaverton, Oreg.

[73] Assignee: NEC America, Inc., Melville, N.Y.

[21] Appl. No.: 569,430

[22] Filed: Dec. 8, 1995

[51] Int. Cl.[6] ..... E02D 27/32

[52] U.S. Cl. ..... 52/295; 248/346.01; 248/346.03; 248/346.5

[58] Field of Search ..... 52/295, 292, 294; 248/346.01, 346.03, 346.5

[56] References Cited

U.S. PATENT DOCUMENTS

| | | | |
|---|---|---|---|
| 1,500,870 | 7/1924 | Holdredge . | |
| 3,477,668 | 11/1969 | Tippmann | 248/346.03 X |
| 3,493,201 | 2/1970 | Marran | 248/346.03 X |
| 3,722,845 | 3/1973 | Unger | 248/346.03 |
| 3,790,115 | 2/1974 | Fox et al. . | |
| 3,963,210 | 6/1976 | Mackun | 52/295 X |
| 4,145,857 | 3/1979 | Tilsen . | |
| 4,365,108 | 12/1982 | Bright . | |
| 4,736,554 | 4/1988 | Tyler | 52/295 X |
| 5,119,606 | 6/1992 | Graham . | |
| 5,235,133 | 8/1993 | Roth et al. . | |

*Primary Examiner*—Carl D. Friedman
*Assistant Examiner*—Yvonne Horton-Richardson
*Attorney, Agent, or Firm*—Sughrue, Mion, Zinn, Macpeak & Seas

[57] ABSTRACT

An anchor frame for securely fastening a remote housing to a concrete pad, formed from one piece of sheet-metal to hold anchor bolts and wires in place when pouring a concrete pad for a remote enclosure, so that the bolts are properly aligned for attaching to the remote enclosure. The anchor frame speeds construction of concrete mounting pads for remote enclosures.

13 Claims, 2 Drawing Sheets

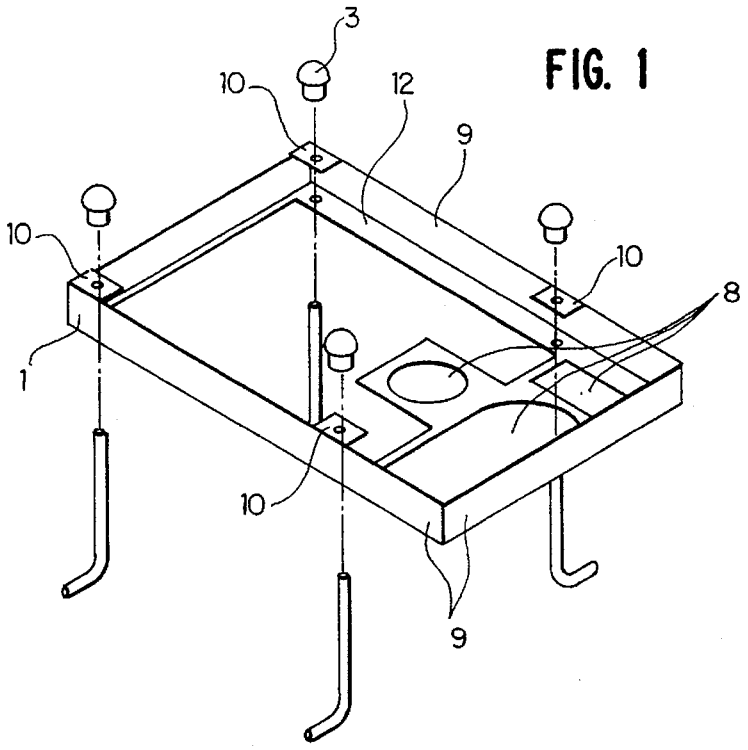
FIG. 1
FIG. 4
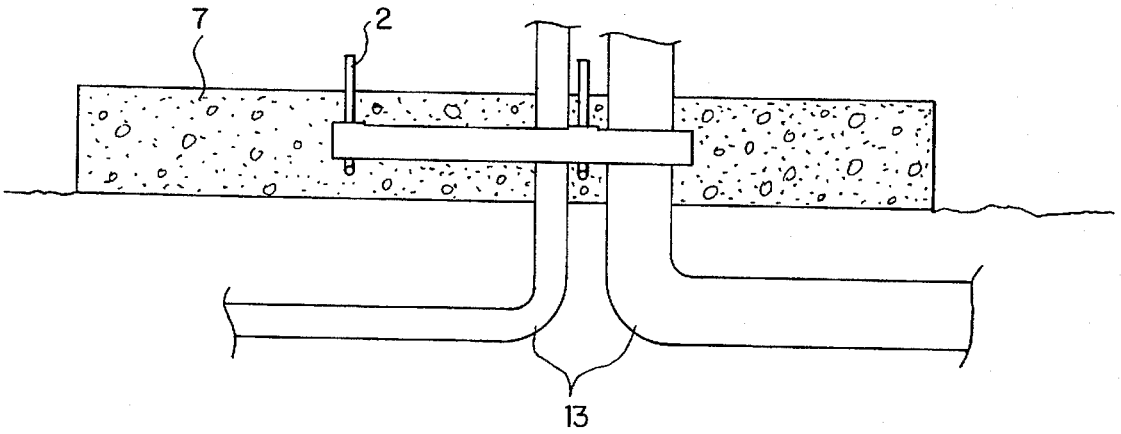

REMOTE ENCLOSURE ANCHOR FRAME AND INSTALLATION METHOD

FIELD OF THE INVENTION

The present invention is directed to the field of remote enclosures for electrical equipment, and more particularly to an anchor frame for mounting a remote enclosure, such as a remote Digital Loop Carrier (DLC) or Private Branch Exchange (PBX), to the ground.

BACKGROUND OF THE INVENTION

When installing telecommunications networks, it is often necessary to place multiplexing equipment, PBX's, DLC's, and other network equipment in remote locations separate from any building structure. Remote enclosures are usually made of metal and anchored either directly to the ground or to a concrete pad.

Anchoring the remote enclosure to a concrete pad provides greater stability than anchoring the enclosure into the ground, however, concrete anchoring requires more time, effort and cost.

Conventional approaches to anchoring remote PBX enclosures onto concrete pads include setting anchor bolts into the wet concrete. To hold the bolts in the wet concrete, a temporary jig can be made to extend over the concrete and suspend anchor bolts into the area where the concrete is poured. When the concrete dries, the jig is removed and the bolts extend out of the concrete pad. The remote enclosure is then mounted onto the anchor bolts. This approach is time consuming and prone to dimensional errors, as the lower ends of the anchor bolts tend to shift when the concrete is poured.

Other approaches use metal frames which are made of angular or tubular metal pieces welded together. These frames are expensive and require labor intensive fabrication.

SUMMARY OF THE INVENTION

It is therefore an object of the present invention to provide a cost effective anchor frame for a remote enclosure which can be easily fabricated and installed, and can be used to facilitate the process of installing remote enclosures onto concrete pads.

It is another object of the present invention to provide a low cost anchor frame which accurately holds anchor bolts while concrete is poured to surround the bolts, so that the bolts later extend out of the dried concrete pad in the proper location where a remote enclosure can receive the bolts.

It is another object of the present invention to provide a low cost anchor frame which guides cables and wires through a concrete pad and into the bottom of a remote enclosure.

These and other objects of the present invention can be realized by providing a unibody anchor frame with preformed wire guide holes and anchor bolt holes which accurately holds the bolts and wires in place while concrete is poured to surround the anchor frame and form the pad.

BRIEF DESCRIPTION OF THE DRAWINGS

The present invention will be more clearly understood from the following description in conjunction with the accompanying drawings, wherein:

FIG. 1 is a perspective view of an embodiment of an anchor frame according present invention;

FIG. 4 is a side cutaway view of an installed anchor frame according to the present invention.

DETAILED DESCRIPTION OF THE PREFERRED EMBODIMENTS

Figure 2:
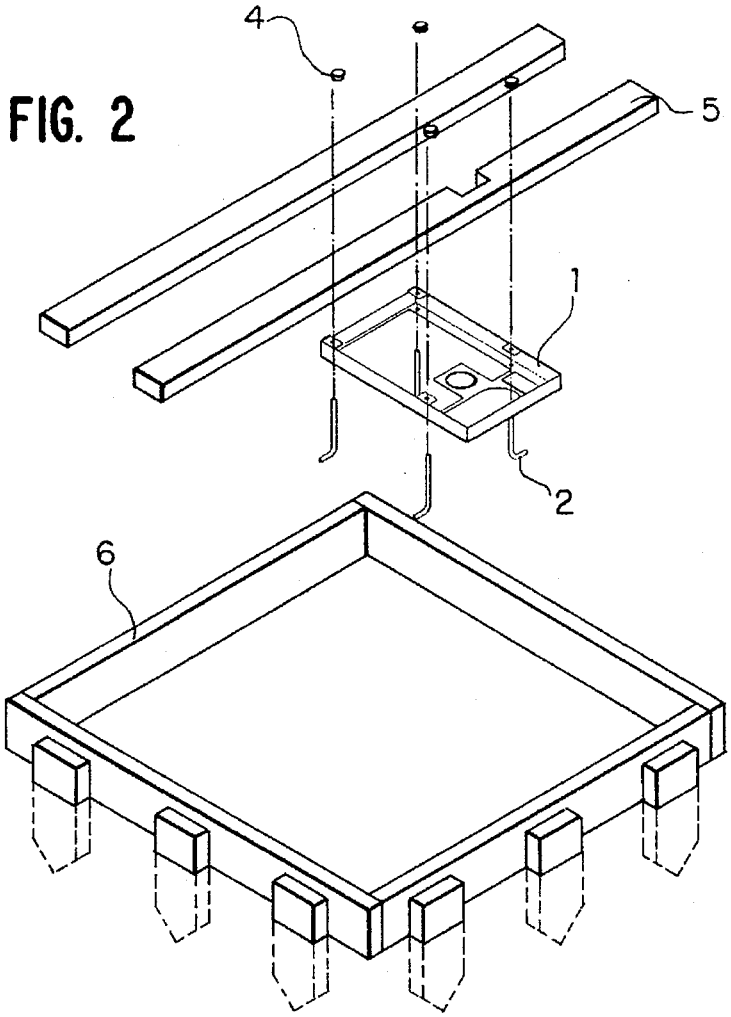
FIG. 2 is a perspective view of an anchor frame and installation accessories according to the present invention.

An embodiment of an anchor frame according to the present invention is shown in FIG. 1. In this embodiment, the anchor frame 1 is one sheet-metal piece with preformed or stamped cable holes 8 in the floor 12 so that buried cables and wires 13 can be fed from the ground through the frame 1 (FIG. 4), and into a remote enclosure (not shown). The edges 9 of the anchor frame 1 are folded upward and have tabs 10 which extend from the edges 9 to be substantially parallel to the floor 12. Anchor holes 11*a* and 11*b* are formed in the tabs 10 and floor 12, respectively, so that anchor bolts 2 can pass through. The tabs 10 with holes 11*a* provide an easily fabricated additional measure of stability, and help keep the bolts 2 straight, especially when concrete is being poured. For ease in installation and increased stability in concrete, L-shaped anchor bolts 2 are used.

The frame 1 is preferably electro-galvanized steel while the anchor bolts 2 are made of stainless steel. The dimensions of the anchor frame 1 should approximate the footprint of the remote enclosure to be installed.

Anchor holes 11*a* and/or 11*b* should create a snug fit with the anchor bolts 2. This will ensure accurate placement and direction of the portion of the bolts 2 which extends from the concrete pad 7. While threaded holes may be used, manufacturing can be simplified by using D-shaped anchor holes 11*a* for threading the anchor bolt. Additionally or alternatively, anchor holes 11*b* could be D-shaped.

Figure 3:
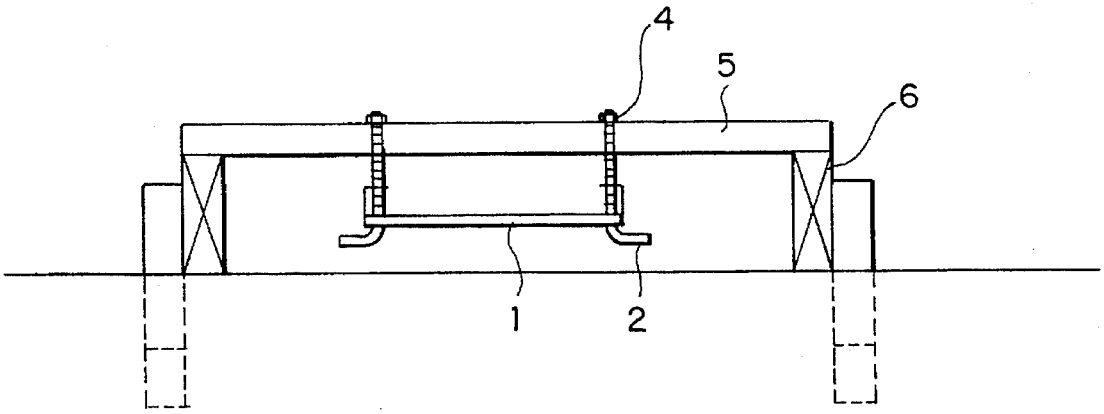
FIG. 3 is side view of an anchor frame and jig according to the present invention.

As shown in FIGS. 2 and 3, the present invention can simplify installation of a remote enclosure onto a concrete pad according to the following steps. Pad size and construction methods may vary to comply with local conditions, practices, or building codes.

1. Prior to pad construction, any ground rods, ground wires, conduit, and cabling should be installed. The conduit and ground wire should be laid in a trench roughly 2 feet deep. A hole should be dug where the concrete is to be poured and the conduit, ground rod, and ground wire should exit the ground through the hole.
2. As shown in FIG. 1, the anchor frame 1 can be shipped with protective plastic caps to be placed over the threaded anchor bolts 2. The anchor frame 1 is first assembled by threading the four L-shaped threaded anchor bolts 2 through the holes 11*a* and 11*b*. The shorter length of the L-shape should be at the bottom.
3. As shown in FIGS. 2 and 3, a jig 5 can be built to hold the anchor frame 1 in place when pouring the cement. Care should be exercised not to cover the conduit openings in the anchor frame 1 with the jig 5. The jig 5 should embed the anchor frame 1 in the cement allowing a sufficient length of the threads to extend above the cement surface (see FIG. 4).
4. After building the jig 5, the plastic bar guards 3 should be removed from the anchor bolts 2 and the anchor frame 1 can be secured to the jig 5 via hex nuts 4. Prior laid wire and/or conduit is then routed through the appropriate openings 8 in the frame (FIGS. 1 and 4). The conduit should extend approximately 2 inches above the cement surface to prevent poured cement from entering the opening.
5. Cement is then poured, and the pad surface is crowned in such a way to provide run-off for water and maintain a level mounting surface for the REX. Crowning will ensure that water does not pool on the top surface of the pad.

6. Once the cement dries, the forms 6 and jig 5 can be removed, and the plastic bar guards 3 can be reinstalled over the anchor bolts 2 until the installer is ready to install the enclosure.

The present invention was developed in conjunction with remote housings to provide additional deployment opportunities, and its development has made a significant contribution to the saleability of these remote housings. While the anchor frame 1 was designed specifically to accommodate a REX housing, it could be modified for use with other housings, such as T-REX housings.

The present invention provides significant advantages over previous anchor frames. For example, fabrication costs are minimized due to a low part count, ease of assembly, low material costs, and minimal labor requirements. In additions, the present invention reduces installation time and costs while improving dimensional accuracy.

As specific embodiments of the invention have been described herein, it will be apparent to those of skill in the art that other modifications may be made within the scope of the invention, and it is intended that the full measure of the invention be determined with reference to the following claims.

I claim:

1. An anchor frame for mounting a remote electronic equipment enclosure to a concrete pad, comprising:

a unibody metal plate to be set in said concrete pad, having anchor holes and wire holes, said anchor holes located to correspond to holes in said enclosure; and a plurality of anchor bolts which pass through said anchor holes to secure said remote electronic equipment enclosure to said concrete pad;

wherein said plate comprises edges folded to extend away from said plate and thereby stabilize said plate in said concrete, at least some of said edges including tabs having additional anchor holes and extending parallel to said plate so that said additional anchor holes align with anchor holes in said plate to receive and stabilize said anchor bolts.

2. The anchor frame according to claim 1, wherein at least one of said anchor holes and at least one of said anchor bolts comprise corresponding threads to securely hold said threaded anchor bolts to said anchor frame.

3. The anchor frame according to claim 1, wherein at least one of said anchor bolts comprises threads, and at least one of said anchor holes comprises D-shaped edges formed to receive said threads and thereby securely hold said bolt to said anchor frame.

4. The anchor frame according to claim 1, wherein at least one of said anchor bolts has threads and at least one set of said anchor holes and said additional anchor holes are formed to capture said threads.

5. The anchor frame according to claim 1, wherein said anchor bolts have threads and said additional anchor holes are D-shaped to capture said threads.

6. The anchor frame according to claim 1, wherein the lower ends of said anchor bolts are L-shaped to stabilize said bolts in said concrete.

7. The anchor frame according to claim 1, wherein said electronic equipment comprises telecommunications equipment.

8. A method of installing a remote enclosure for electronic equipment connected to wires, comprising the steps of:

preparing a cavity to contain concrete near said wires;

providing a unibody metal plate having anchor holes and wire holes;

installing anchor bolts through said anchor holes to support the underside of said unibody plate and extend above said unibody plate;

placing said unibody plate with installed anchor bolts into said cavity;

feeding said wires to be connected to said electronic equipment through said cavity and said wire holes;

filling said cavity with concrete to a level below the top of said anchor bolts; and mounting said remote enclosure onto said anchor bolts after said concrete dries.

9. The method according to claim 8, wherein said step of placing said unibody metal plate further comprises the step of suspending said plate in said cavity from a jig, said jig being connected to said anchor bolts.

10. The method according to claim 9, further comprising the step of removing said jig after said filling step.

11. The method according to claim 8, wherein said cavity is a hole in the ground.

12. The method according to claim 8, wherein said cavity is framed to contain said concrete above ground.

13. An anchor frame for mounting a structure to a concrete pad, comprising:

a unibody metal plate to be submerged in said concrete pad, having anchor holes, said anchor holes located to correspond to holes in said structure; and a plurality of anchor bolts which pass through said anchor holes to secure said structure to said concrete pad;

wherein said plate comprises at least one edge folded to extend away from said plate and thereby stabilize said plate while submerged in said concrete, said at least one edge including at least one tab having an additional anchor hole and extending parallel to said plate so that said additional anchor hole aligns with a corresponding anchor hole in said plate to receive and stabilize one of said anchor bolts.

* * * * *